US011618659B2

(12) United States Patent
Schlabach

(10) Patent No.: US 11,618,659 B2
(45) Date of Patent: Apr. 4, 2023

(54) METHOD AND APPARATUS FOR RETAINING A LIFTING DEVICE ON A FORK

(71) Applicant: Kuhns Mfg. LLC., North Bloomfield, OH (US)

(72) Inventor: Willard Schlabach, Sullivan, IL (US)

(73) Assignee: NORDEN MFG LLC, North Bloomfield, OH (US)

( * ) Notice: Subject to any disclaimer, the term of this patent is extended or adjusted under 35 U.S.C. 154(b) by 67 days.

(21) Appl. No.: 17/307,406

(22) Filed: May 4, 2021

(65) Prior Publication Data

US 2021/0403300 A1 Dec. 30, 2021

Related U.S. Application Data

(63) Continuation of application No. 17/100,275, filed on Nov. 20, 2020.

(60) Provisional application No. 63/043,987, filed on Jun. 25, 2020.

(51) Int. Cl.

| | |
|---|---|
| ***B66F 9/07*** | (2006.01) |
| ***B66F 9/075*** | (2006.01) |
| ***B66F 9/18*** | (2006.01) |

(52) U.S. Cl.

CPC ..... *B66F 9/07504* (2013.01); *B66F 9/18* (2013.01)

(58) Field of Classification Search

CPC ..... B66F 9/12; B66F 9/127; B66F 9/07504; B66F 9/18

See application file for complete search history.

(56) References Cited

U.S. PATENT DOCUMENTS

| | | | | |
|---|---|---|---|---|
| 3,207,085 | A * | 9/1965 | Burr | B61J 3/12 105/72.2 |
| 3,809,264 | A * | 5/1974 | Mayers | B65G 67/20 414/404 |
| 4,065,013 | A | 12/1977 | Orthman | |
| 4,824,317 | A | 4/1989 | Schroder | |
| 5,433,493 | A * | 7/1995 | Dix | B65F 1/1452 294/104 |
| 7,597,526 | B2 * | 10/2009 | Benson | B66F 9/18 414/420 |
| 8,104,783 | B2 | 1/2012 | Blankenship et al. | |
| 8,684,655 | B2 | 4/2014 | Cannon | |
| 9,371,685 | B2 * | 6/2016 | Cooper | E06B 7/28 |

* cited by examiner

*Primary Examiner* — Gregory W Adams

(74) *Attorney, Agent, or Firm* — Sand, Sebolt & Wernow Co., LPA

(57) ABSTRACT

A method and apparatus for moving trailers using a trailer moving apparatus coupled to a forklift is shown and described herein. The method and apparatus for moving trailers uses a trailer moving apparatus engageably coupled to a forklift when lifted off a surface with a plurality of hitches at different heights. The method for moving trailers using a trailer moving apparatus operatively coupled to a forklift tine via a guided channel on a channel member and not requiring an operator to leave the cabin of the forklift during operation.

24 Claims, 14 Drawing Sheets

METHOD AND APPARATUS FOR RETAINING A LIFTING DEVICE ON A FORK

REFERENCE TO RELATED APPLICATIONS

This application is a Continuation of U.S. application Ser. No. 17/100,275 filed Nov. 20, 2020, which application claims the benefit of U.S. Provisional Application Ser. No. 63/043,987 filed Jun. 25, 2020, the entire disclosures of which are incorporated herein by reference.

TECHNICAL FIELD

Generally, the disclosure relates to a method and apparatus for moving trailers using a trailer moving apparatus coupled to a forklift. Particularly, the disclosure relates to a method and apparatus for moving trailers using a trailer moving apparatus engageably coupled to a forklift when lifted off a surface with a plurality of hitches at different heights. Specifically, the disclosure relates to a method and apparatus for moving trailers using a trailer moving apparatus operatively coupled to a forklift tine via a guided channel on a channel member and not requiring an operator to leave the cabin of the forklift during operation.

BACKGROUND OF THE INVENTION

Background Information

Moving trailers can become very cumbersome as a daily task. Often, a plurality of trailers is positioned in a parking area in a commercial, agricultural, or home setting. Often these trailers have to be moved around the yard or building, be loaded, unloaded, or otherwise moved into or out of position. Using a traditional truck or car hitch can be slow and cumbersome. Additionally, these vehicles tend to be much less maneuverable. Towards that end, a need exists for a better way to move trailers in a quick, efficient and nimble way.

A forklift is a common piece of equipment that is readily found at many companies worldwide. The forklift is generally operative to transport small objects, bulky objects, or use its tines to engage a pallet or other such skid type of platform. Although not a traditional use, forklifts are used to move trailers short distances or precisely moving them to a desired location. Generally, the interface between the forklift and the trailer is an unwieldly drop-in pin. The use of such pin requires the operator to unmount from the forklift and remount into the forklift whenever the trailer is hitched or unhitched. This mounting and dismounting is a vector for injuries or other safety hazards. A typical way of reducing the amount of times that the operator has to mount and unmount to perform these various procedures is to have a second person perform many of these various procedures.

SUMMARY OF THE INVENTION

Therefore, a method and apparatus that solves many of the problems associated with moving trailers is desired. The method and apparatus as described herein allows for movement of trailers and other mechanisms via a forklift in a manner which is quick, easy, and cost effective.

In one aspect, an apparatus for moving trailers comprising: a frame including: at least one channel member with a body extending in a longitudinal direction; a guided channel formed by the at least one channel member adapted to accept a tine of a lifting device; a retaining assembly movable between an accepting position and an engaged position; and at least one hitch located on the apparatus adapted to accept an external hitch coupler on a trailer. This embodiment or another exemplary embodiment may provide the retaining assembly is in the accepting position when the apparatus is in contact with a surface and the engaged position when the apparatus is not in contact with the surface. This embodiment or another exemplary embodiment may provide the at least one channel member has a front side and a back side and the guided channel runs parallel to the channel member; and the guided channel has a top wall and a tapered bottom wall that has a first width proximate the front side of the at least one channel member and second width less than the first with proximate the back side of the at least one channel member. This embodiment or another exemplary embodiment may provide the retaining assembly further comprises: a pivot arm that extends beyond the tine and in a first positon that is below the tine and a second positon that is behind the tine. This embodiment or another exemplary embodiment may provide the pivot arm extends out from the body of the guided channel and is bent at 90 degrees and is below the guided channel in the accepting position and above a portion of the guided channel in the engaged position. This embodiment or another exemplary embodiment may provide a second pivot arm that moves in unison with the first pivot arm. This embodiment or another exemplary embodiment may provide a plurality of arms including a U-shaped arm, an upwardly extending arm, and a diagonal arm connected to a crossbar; a pivot point permitting the arms to pivot together; and a base operative to retain the retaining mechanism in fixed engagement with the guided channel. This embodiment or another exemplary embodiment may provide a biasing member operative to move between a first position and second position. This embodiment or another exemplary embodiment may provide the biasing member is a spring that extends between the arm and the frame. This embodiment or another exemplary embodiment may provide a stop on the frame operative to prevent over-rotation of the retaining assembly. This embodiment or another exemplary embodiment may provide the stop is located above the channel member. This embodiment or another exemplary embodiment may provide a ball mount; a hitch frame, wherein the hitch frame houses a hitch receiver is adapted to accept the ball mount; and a pin that spans the hitch receiver and is operative to retain the ball mount within the receiver.

In another aspect, an exemplary embodiment of the present disclosure may provide a method for moving trailers comprising: engaging a tine of a vehicle with at least one channel member within a guided channel of a trailer moving apparatus; lifting the trailer moving apparatus off of a surface; retaining the trailer moving apparatus to the tine of the vehicle simultaneous to lifting the trailer moving apparatus; aligning a hitch located on the trailer moving apparatus with a coupler on a trailer desired to be moved; coupling the hitch on the trailer moving apparatus with the coupler on the trailer desired to be moved; and moving the trailer with the apparatus coupled to the tine of the vehicle. This embodiment or another exemplary embodiment may provide rotating a retaining assembly when the apparatus is lifted off the surface; and assuring that the tine is intermediate the frame and a portion of the retaining assembly. This embodiment or another exemplary embodiment may provide locking a spring biased member from an open positon to a closed position in order to retain the trailer moving apparatus to the tine of the vehicle. This embodiment or another exemplary embodiment may provide contacting the ground with a crossbar to overcome the spring biased member in order to move it from the closed position to the open position. This embodiment or another exemplary embodiment may provide opening the retaining assembly as a result of contacting the ground. This embodiment or another exemplary embodiment may provide removing a pin located in a hitch receiver; disengaging a ball mount with a plurality of hitches from the hitch receiver; changing the ball mount in at least one of a front to back or side to side manner to expose desired hitch; reengaging the ball mount with the hitch receiver; and returning the pin to the hitch receiver. This embodiment or another exemplary embodiment may provide lowering the apparatus with the trailer connected thereto; disengaging the hitch on the apparatus from the coupler on the trailer; aligning a second hitch located on the trailer moving apparatus at a height different from the hitch with a coupler on a second trailer desired to be moved; coupling the second hitch on the trailer moving apparatus with the coupler on the second trailer desired to be moved; and moving the trailer with the apparatus coupled to the tine of the vehicle. This embodiment or another exemplary embodiment may provide whereby all steps are done without an operator leaving the vehicle.

BRIEF DESCRIPTION OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A new trailer moving apparatus 10 and method of operation thereof is depicted in the present disclosure and throughout FIGS. 1-10B. The disclosure focuses on an improved trailer moving apparatus that may be used in conjunction with a common forklift, or otherwise a lifting device, as will be discussed hereafter.

Figure 1:
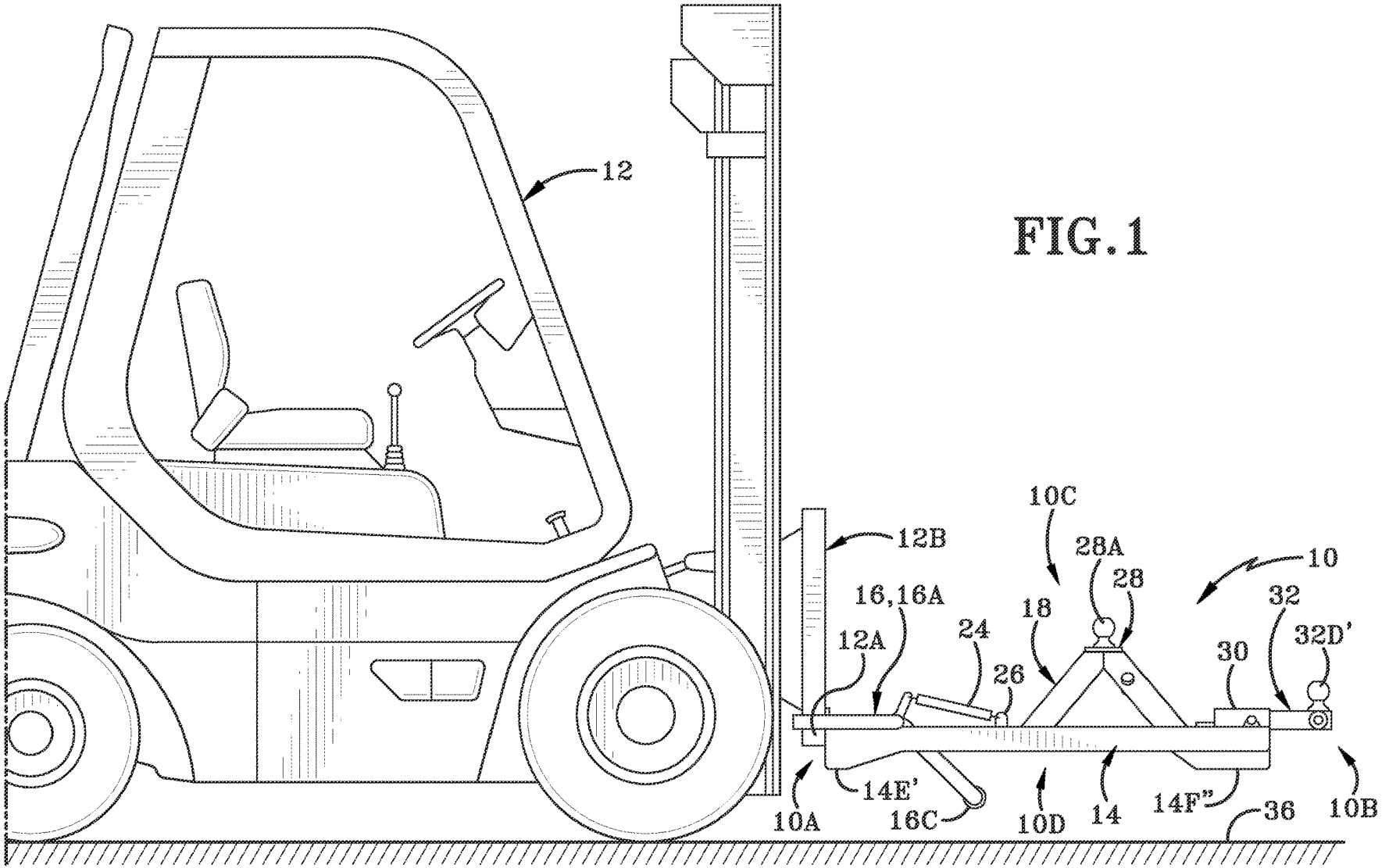
FIG. 1 is a left side elevation view of a moving apparatus in accordance with the present disclosure shown engaged with a forklift.

Referring specifically to FIG. 1, an operational view of an exemplary trailer moving apparatus 10 is shown. The trailer moving apparatus 10 is engaged with a tine 12A of a forklift 12. The forklift 12 has a carriage 12B lifted off of the ground, ready for a trailer (not shown).

Figure 2:
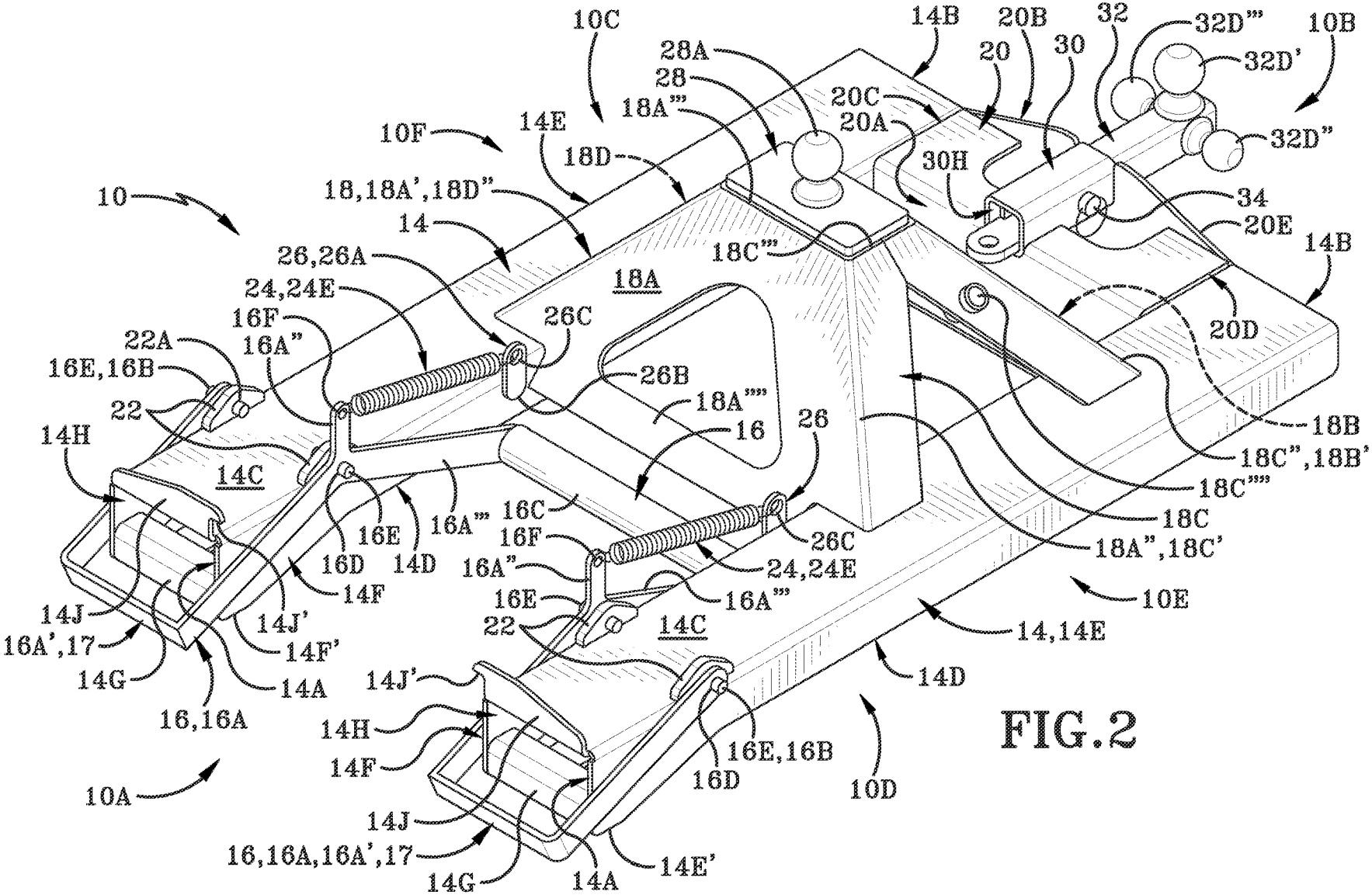
FIG. 2 is a front, top right side isometric perspective view of the moving apparatus in accordance with the present disclosure shown in isolation.
Figure 2A:
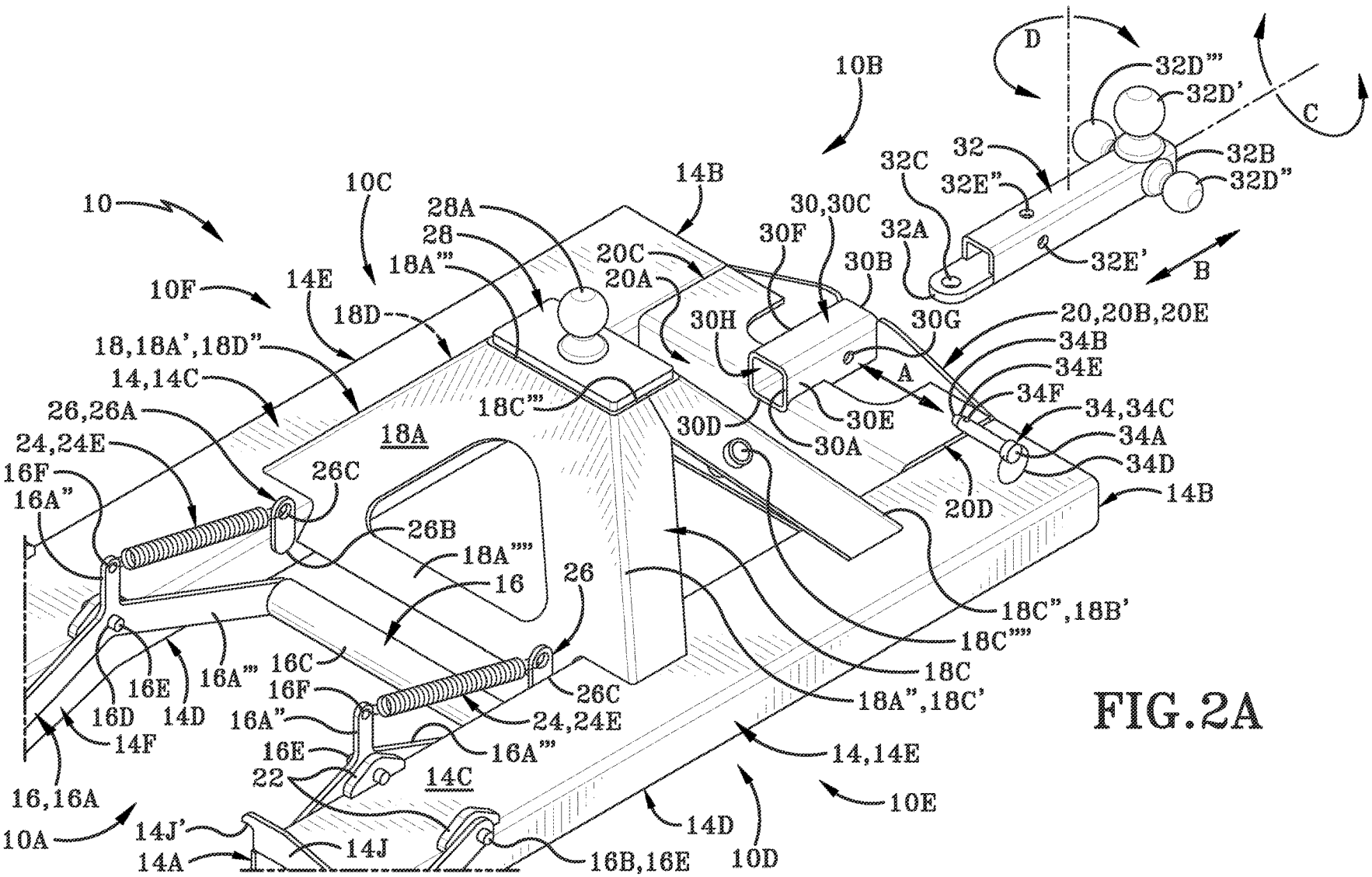
FIG. 2A is a partial exploded front, top, right side isometric perspective view of the moving apparatus shown in FIG. 2.

Referring specifically to FIG. 2 and FIG. 2A, a pair of isometric views of the exemplary trailer mover apparatus 10 are shown. The trailer mover apparatus 10 is shown as if it were in contact with the ground or other surface (not shown). The trailer mover apparatus 10 has a body that generally includes two hollow channel members 14 connected with a retaining assembly 16, a pyramidal shaped frame 18, and a hitch frame 20. The trailer mover apparatus 10 has a front side 10A and a back side 10B longitudinally disposed thereto. Further, there is a top side 10C and a bottom side 10D transversely opposed thereto. The trailer mover apparatus 10 further includes a first side 10E and a second side 10F laterally opposed thereto.

The two hollow channel members 14 are mirror images of one another and as such will be referred to as if they are identical in labeling of their parts. The channel members 14 each have a body with a front side 14A and a rear side 14B longitudinally disposed thereto. Further, there is a top side 14C (FIG. 3) and a bottom side 14D (FIG. 4) transversely opposed thereto. The channel members 14 further include an outer side 14E and an inner side 14F laterally opposed thereto. The outer side 14E and inner side 14F are longer towards each the front side 14A and the rear side 14B elevating the rest of the body off of the ground making a relatively wide base inverted U-shape. The front side 14A of the channel members contains a horizontal member 14G proximate the bottom side 14D. The horizontal member 14G is operative to create a guided channel 14H within the body of the channel members 14. The front side 14A at its top 14C also includes a retaining ledge 14J, or stop. The retaining ledge 14J is generally upright in nature and is operative to prevent the retaining assembly 16 from over rotating at a projection 14J' of the retaining assembly 14J that projects towards the retaining assembly 16, which will be discussed with respect to the operation. In the embodiment as is shown, the retaining ledge 14J may be integrally formed with the same material with the top side 14C. Other embodiments provide for the retaining ledge 14J not to be integrally formed and instead is attached via an attachment mechanism to the top side 14C of the channel member 14.

On the top surface 14C of the channel members proximate the front side 14A is the retaining assembly 16. The retaining assembly 16 is operative to hold the tine of a forklift 12 in engagement when the apparatus 10 is no longer in contact with a surface. The retaining assembly 16 has two arms 16A. The arms 16A are generally U shaped with a base 17 at a first portion 16A' connected at a pivot point 16B to an upwardly extending arm 16A" and a diagonal arm 16A'". The diagonal arm 16A'" of each arm 16A is connected at an end opposite the pivot point 16B with a crossbar 16C.

At the pivot point 16B and at the opposite side of the first portion 16A' is an aperture 16D with a retaining pin 16E. The retaining pin 16E is operative to connect the arm 16A to a stationary base 22. The stationary base 22 has a body attached to the top 14C of the channel member 14 proximate the front side 14A. The stationary base 22 has an aperture 22A operative to receive the retaining pin 16E and allow the pin 16E to rotate, as will be discussed later with respect to operation. In the exemplary embodiment there are four stationary bases for each channel member 14 so as to allow two rotation points for connection and rotation to the channel member 14. However, alternative embodiments may have one integrated axis or one for each channel member 14.

Near a top portion of the upwardly extending arm 16A" is a spring aperture 16F. The spring aperture 16F is operative to accept a first end 24A of a spring 24 via a hook 24A'. The spring 24 further has a body which further includes a second end 24B that is longitudinally opposed to the first end 24A. The second end further includes a second hook 24B'.

The second hook 24B' is engaged with a stanchion 26. The stanchion 26 has a body with a first end 26A that is attached to the inner side 14F of one of the channel members and the outer side 14E of the other channel member. The stanchion 26 further includes a second end 26B that is longitudinally disposed to the first end 26A. Proximate the second end 26B is an aperture 26C in which the second hook 24B' interfaces with the stanchion 26.

While engaged with the ground or other surface, the spring 24 is operative to be in an extended position 24E. In this extended position 24E the guided channel 14H of the channel member 14 remains accessible. This is due to the crossbar 16C being in contact with the ground, thereby keeping base 17 of the U-shaped member 16A' of the arms 16 from obstructing the guided channel 14H of the channel member 14. Additionally, while not in contact with the ground the spring 24 is in a retracted position 24R as will be discussed with respect to operation. The arms 16A' 16A", 16A'" are at an angle of approximately 120 degrees to each other. As such, the arms are spring biased between an open and closed position. In alternative embodiments the angles may be different depending on the stiffness of the springs used.

The pyramidal frame 18 is located between the front side 10A of the apparatus 10 and front side 14A of the channel member 14 and the rear side 10B of the apparatus 10 and the rear side 14B of the channel member 14. The pyramidal frame 18 has a body that is generally pyramidal with four triangular faces, a front face 18A that angles towards a rear face 18B that is generally longitudinally disposed to the front face 18A and angled towards the front face 18A, a first side 18C angled towards a second side 18D angled toward the first side 18C and is generally laterally opposed thereto. The front face 18A interfaces at a first end 18A' with a second end 18D" of the second side 18D and at a second end 18A" with a first end 18C' of the first side 18C. The rear face 18B interfaces at a first end 18B' with a second end 18C" of the first side 18C and at a second end 18B" with a first end 18D' of the second side 18D. On the first side 18C there is further shown an aperture 18C"". This aperture 18C'" may hold excess couplers or pins, as will be discussed later when describing future elements. In the exemplary pyramidal frame 18 as is shown an amount of material versus to comprise the frame and the amount of open space between each respective first end 18A', 18B', 18C', 18D', and each respective the second end 18A", 18B", 18C" and 18D". One skilled in the art may tailor the requirements of material versus open space based on the ultimate desired weight of the moved devices. Further, the pyramidal frame 18 could be made of one integrated piece, or could be any combination of pieces to form the pyramidal frame 18 as shown and described herein.

Further, each side 18A, 18B, 18C, 18D has a flat portion 18A'", 18B'", 18C'" and 18D'" that interfaces in a similar manner as to the sides 18A', 18B'. 18C', 18D', 18A", 18B", 18C", 18D". Interfacing at the flat portion 18A'", 18B'", 18C'" and 18D'" is an engagement platform 28. The engagement platform 28 includes a hitch 28A. In the exemplary embodiment, a standard rise hitch is shown. In alternative embodiments, a high rise hitch could be used as well. Further, the hitch may vary in diameter depending on the types and weights trailers to be moved. Additionally, a recess may be used to receive a king pin of a semi-trailer. The general height of the hitch 28A is operative to engage gooseneck hitches, as will be discussed later with respect to operation.

The hitch frame 20 has a body with a front side 20A and a back side 20B longitudinally disposed thereto. Further, the hitch frame 20 further includes a first side 20C and a second side 20D laterally opposed thereto. Within the front side 20A and back side 20B is a hitch receiver 30 that spans the first side 20C to the second side 20D. The hitch receiver 30 is integrally formed with the body of the hitch frame 20. The hitch receiver 30 has a body that is generally a hollow tubular in nature with a front end 30A and a back end 30B longitudinally disposed thereto. Further, the hitch receiver 30 further includes a top side 30C and a bottom side 30D transversely opposed thereto and a first side 30E and a second side laterally opposed thereto. Within a side 30A, 30B, 30C, 30D of a hitch receiver 30 is a through hole 30G.

Within the hitch receiver 30 is a ball mount 32. The ball mount has a generally tubular body which includes a front side 32A, and a rear side 32B. At the front side 32A, is an aperture 32C. Further, the second end 32B contains a plurality of hitches 32D', 32D", 32D'". Each of the hitches 32D', 32D", 32D'" are different diameters used with different types and sizes of couplers. The hitches 32D', 32D", 32D'"

may be made of various materials including but not limited to: chrome, stainless steel, zinc, heat treated stainless steel, or nickel. The size of the balls may be traditionally 1⅞", 2", and 2⁵⁄₁₆", but may be any size that will couple to a desired coupler. The aperture 32C is operative to be outfitted with a separate hitch different from the hitches 32D', 32D", 32D'" to further allow for a variety of hitches used within the apparatus 10.

Referring specifically to FIG. 2A, the ball mount 32 is shown separated from the hitch receiver 30 as shown. In this view a pin 34 has been removed from the through hole 30G of the hitch receiver 30 and from a first through hole 32E' in the ball mount 32. The first through hole 32E' runs in a lateral manner, while a second through hole 32E" runs in a longitudinal direction as shown in this figure. The pin 34 has a body that is generally cylindrical in nature with a first end 34A and a second end 34B laterally opposed thereto. At the first end 34A there is a bulbous head portion 34C with an engageable handle 32D. At the second end 34B of the pin 34 there is a tapered portion 34E. Proximate the tapered portion 34E is a bearing 34F. The bearing 34F is operative to restrict movement of the pin 34 while inserted and no force is applied to the pin about its engageable handle 34D. The pin 34 is inserted into the through hole 30G of the hitch receiver 30 at the first side 30E and enter into the through hole 32E' or 32E" of the ball mount 32 before the other side of the hitch receiver 30F at its aperture 30G. The bearing 34F of the pin 34 is then operative to retain the ball mount 32 within the hitch receiver 30. The pin 34 is removed in the opposite direction in which it was placed. This insertion or removal of the pin 34 is indicated by arrow "A".

When the pin 34 is removed, the ball mount 32 is no longer in operative connection with the hitch receiver 30 and may be removed as indicated by arrow "B". The ball mount 32 may be rotated via arrow "C" when it is removed from connection with the hitch receiver. This rotation would bring the front side 32A of the ball mount to where the rear side 32B was, or vice versa depending on the configuration at the time. The pin 34 is reengaged after this rotation "C". The ball mount 32 is rotated via arrow "D" in order to allow an additional hitch 32D', 32D", 32D'" to face upright and be able to be engaged. The ball mount 32 is rotated via arrow "D", either 90 degrees or 270 degrees and is required to engage the second through hole 32E" with the pin 34 in order to operative hold the ball mount 32 within the hitch receiver 30. If the ball mount 32 were to be rotated via arrow "D" 180 degrees, the pin 34 may engage the first through hole 32E' but merely would do it from the opposite side as from the displayed position in FIG. 2 and FIG. 2A.

Figure 3:
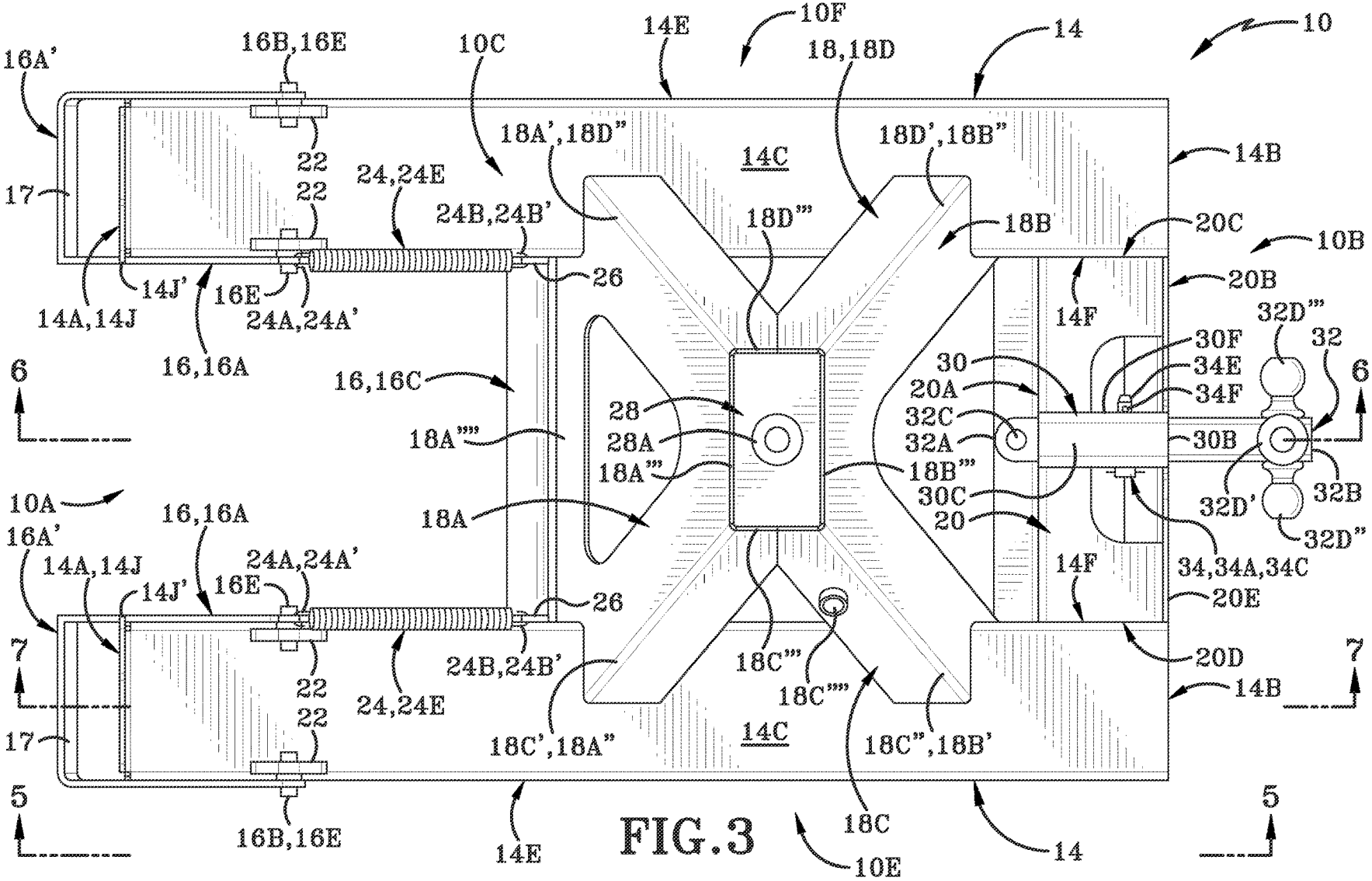
FIG. 3 is a top plan view of the moving apparatus shown in FIG. 2.

Referring now to FIG. 3 a top plan view of the exemplary trailer mover apparatus 10 is shown. In this top plan view the pin 34 passes through the entirety of the hitch receiver 30 and the ball mount 32 is shown. From this view the entirety of the pyramidal frame 18 with its interfacing sides as discussed earlier. Additionally, the entirety of the retaining pin 16E of the retaining assembly 16 with its connection to the stationary base 22 is shown.

Figure 4:
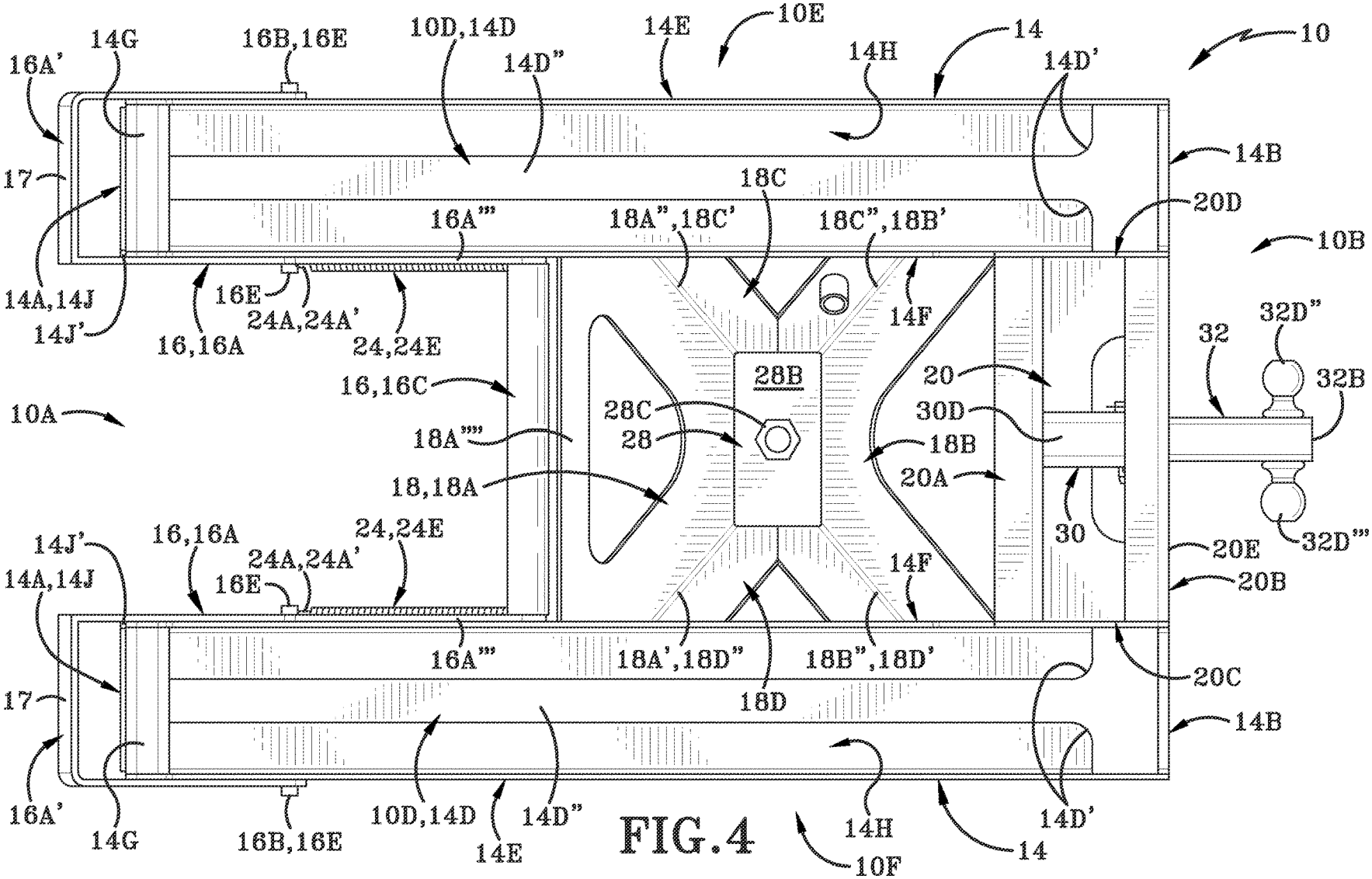
FIG. 4 is a bottom plan view of the moving apparatus.

Referring now to FIG. 4, a bottom plan view of the exemplary trailer mover apparatus 10 is shown. Within this view, the bottom side 14D of the channel member is shown. Specifically, proximate the front side 14A of the channel member 14 the bottom side spans the entire width of the bottom side 14D before tapering with a pair of arced surfaces 14D' before terminating to a strip portion 14D" that spans until the horizontal member 14G. As is shown in this embodiment, the lack of a full bottom side allows for the apparatus 10 to be lighter while still providing structural integrity. Further, this merely an exemplary embodiment and other embodiments may provide for a bottom side 14D.

Additionally, a bottom side 28B of the engagement platform 28 is shown. At the bottom side 28B a retaining member 28C is shown. This retaining member 28C is operative to hold the hitch 28A in operative and static engagement with the engagement platform 28 thereby securing the hitch 28A to the engagement platform 28. In an alternative embodiment, if a different size hitch were desired to be used, the retaining member 28C is thereby removed and a new hitch is installed.

Figure 5:
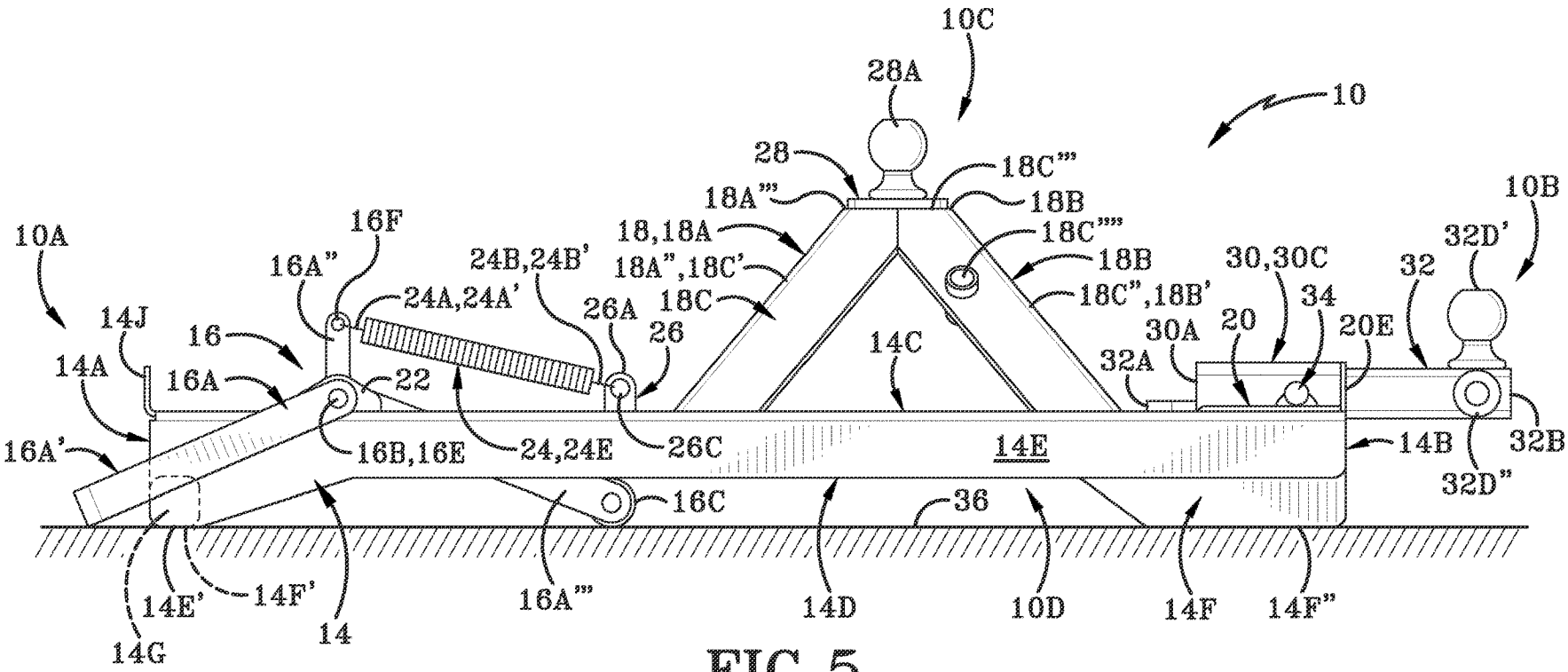
FIG. 5 is a right side elevation view of the moving apparatus looking in the direction of the line 5-5 of FIG. 3, and showing the moving apparatus in contact with a support surface such as the ground.

Referring now to FIG. 5, a left side view of the exemplary trailer mover apparatus 10 along line 5-5 in FIG. 3 is shown. This left side view shows the apparatus 10 in contact with a surface 36. The crossbar 16C of the retaining assembly 16 and the U-shaped arms 16A' are both in contact with the surface 36, permitting the guided channel 16H to be accessible by the tines 12A of a forklift 12. The outer side 14E and inner side 14F being longer towards each the front side 14A and the rear side 14B are shown elevating the rest of the body off of the ground making a relatively wide base inverted U-shape with only a portion 14E', a front side interior wall 14F' and a rear side interior wall 14F" in contact with the surface 36.

Figure 6:
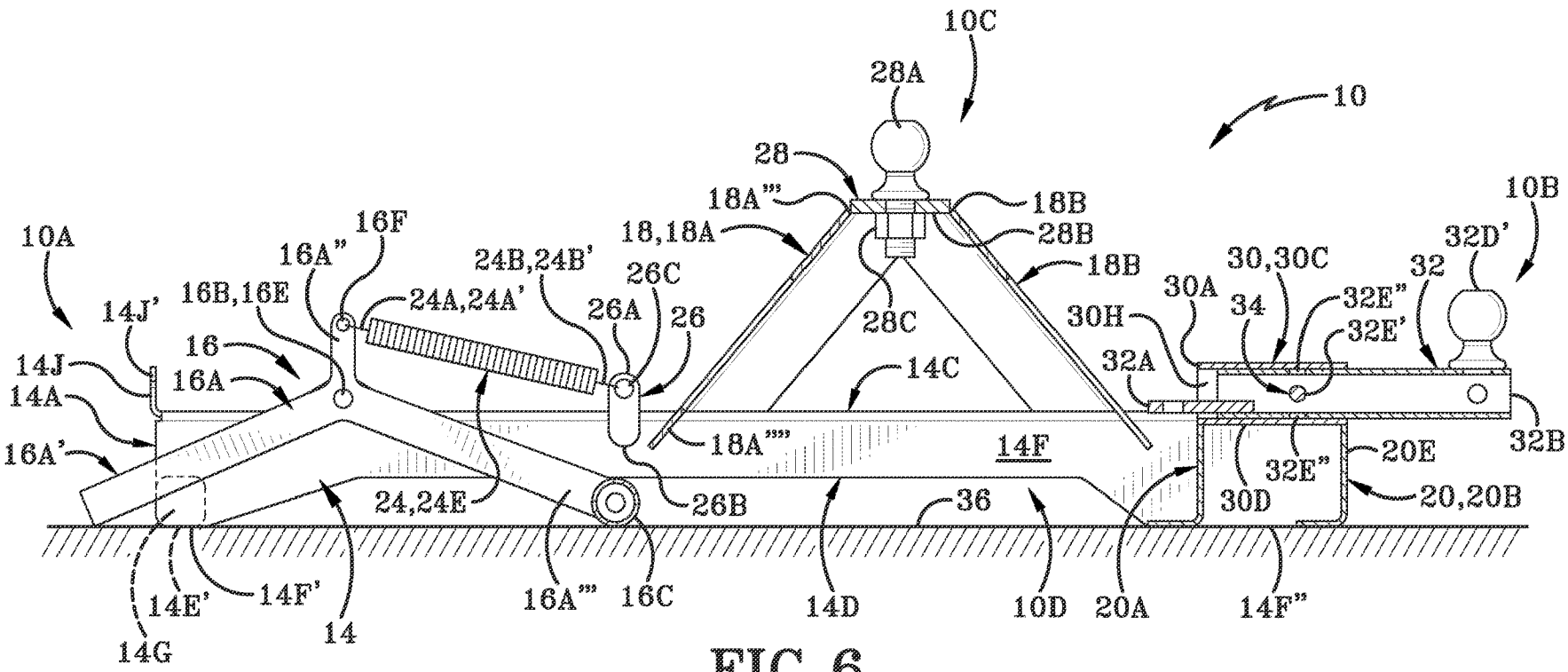
FIG. 6 is a cross-sectional view of the moving apparatus taken along line 6-6 of FIG. 3 and showing the moving apparatus in contact with the support surface such as the ground.

Referring to FIG. 6, a cross sectional view of the exemplary trailer mover apparatus 10 along line 6-6 in FIG. 3 is shown. The exemplary trailer mover apparatus 10 is shown in this figure in contact with a surface 36. In this cross sectional view, the engagement platform 28 with the hitch 28A engaged with its retaining member 28C at the bottom side 28B is shown. Further, the pin 34 is shown in cross section as it passes through the hitch receiver 30 engaging the ball mount 32 to operatively connect the hitch receiver 30.

Further shown are pieces 18A"", 18B"" of the pyramidal frame on the front side 18A and rear side 18B that are below the top 14C of the channel member 14. Additionally, shown is the hitch frame 20 with support frame 20E that is operative to support the entirety of the hitch frame including the hitch receiver 30 and the ball mount 32, particularly when the ball mount is engaged with a trailer as will be discussed with respect to operation.

Figure 7:
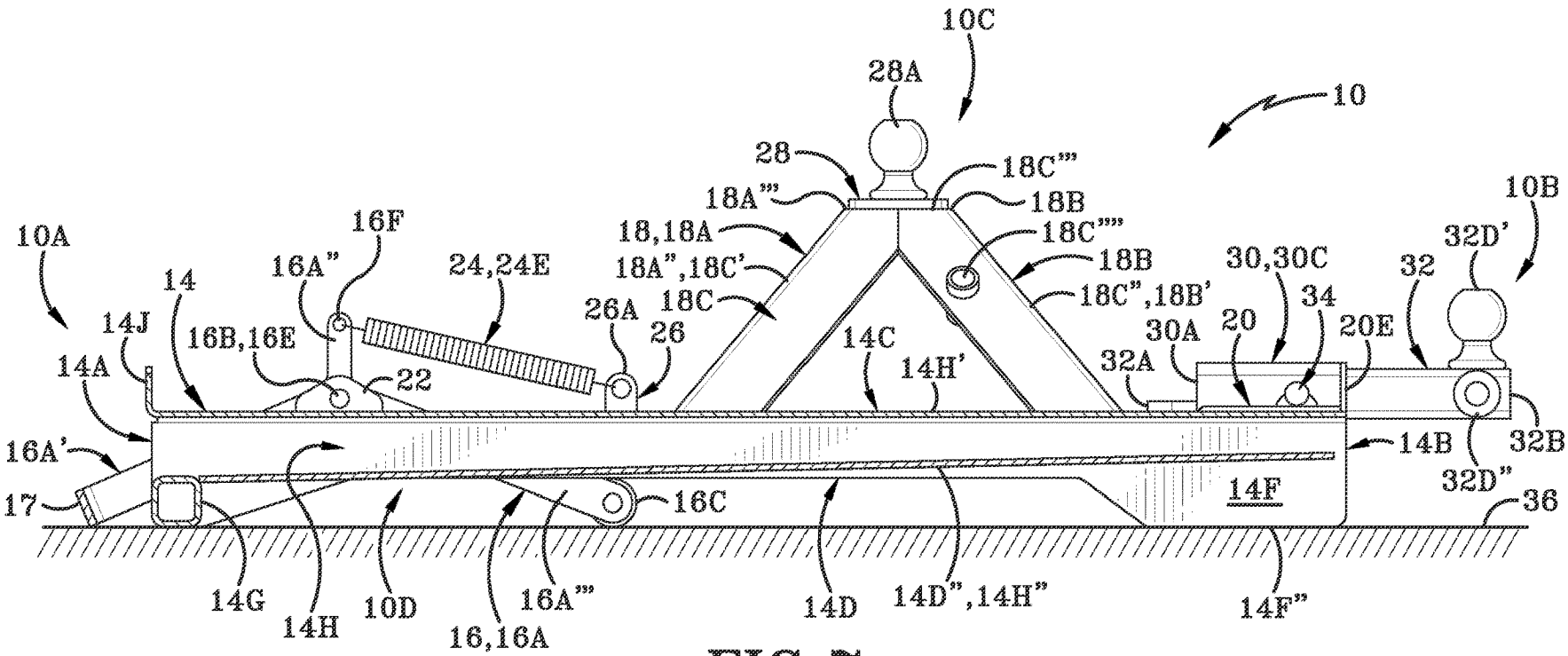
FIG. 7 is a cross-sectional view of the moving apparatus taken along line 7-7 of FIG. 3 and showing the moving apparatus in contact with the support surface such as the ground.

Referring now FIG. 7 (FIG. 7) a side cross sectional view of the exemplary trailer mover apparatus 10 along line 7-7 in FIG. 3 is shown. The exemplary trailer mover apparatus 10 in this figure is shown in contact with a surface 36. Line 7-7 bisects the channel member 14. In this view, there is shown an interior of the channel member 14, specifically the guided channel 14H. The guided channel 14H has a top wall 14H' that is generally commiserate with the top side 14C.

The guided channel 14H in the exemplary embodiment also has a bottom wall 14H" that slopes from the front side 14A toward the rear side 14B. This slope permits the tine 12A of a forklift 12 to be further guided within the guided channel 14H of the channel member 14 so as to hold the tine close and minimize movement of the tine 12A as the surface 36 to move across is often not perfectly flat in nature. This sloped bottom wall 14H" will be further discussed with respect to operation. In further exemplary alternative embodiments, the bottom wall 14H" may not be sloped, or present whatsoever, but in either such case it would lead the forklift to be more unwieldly during operation.

Having thus described an exemplary non-limiting configuration of the exemplary trailer mover apparatus 10, its operation will be discussed with reference to some exemplary features used with the various embodiments.

Figure 8A:
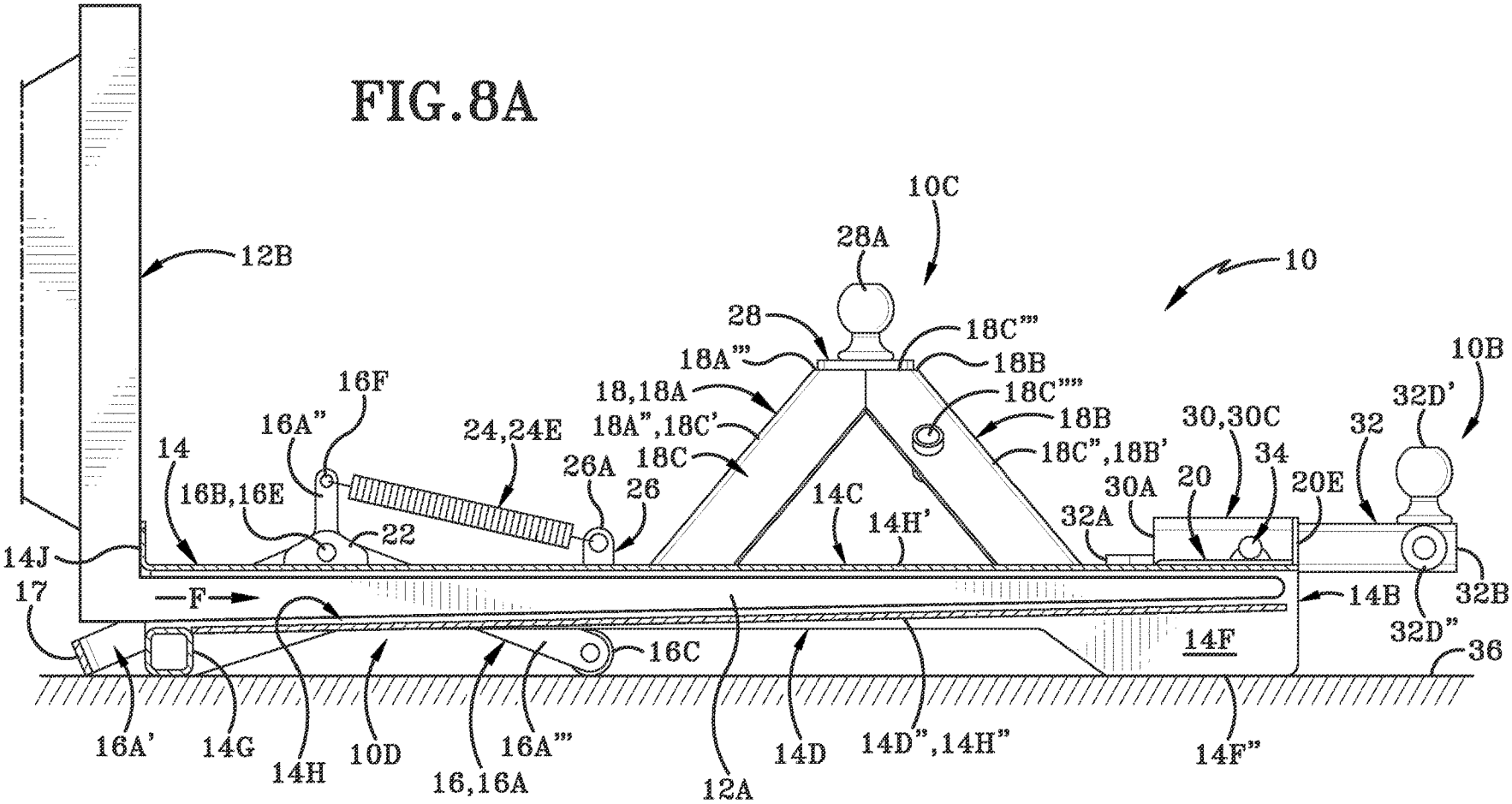
FIG. 8A is a cross-sectional view of the moving apparatus similar to FIG. 7 shown resting on the support surface or the ground, with the retaining assembly in an open position and showing a tine of a forklift being inserted into the channel member of the moving apparatus.

Referring now to FIG. 8A a side cross section operational view of the exemplary trailer mover apparatus 10 engaging a forklift tine 12 into the trailer mover apparatus 10 is shown. Similar to FIG. 7, this view is along the same line 7-7 for the apparatus 10, but the forklift tine 12A has been inserted into the apparatus 10. The exemplary trailer mover apparatus 10 in this figure is shown in contact with a surface 36.

In this figure the forklift tine 12A has been inserted via arrow "F" into the channel member 14. The tine 12A must be raised or lowered by the forklift 12 in order to align with the guided channel 14H of the channel member 14. The movement in an upward or downward manner is done by an operator (not shown) operating the forklift 12 to raise the height of the forks above the horizontal member 14G yet below the top wall 14H' of the guided channel 14H. Aligning the tine 12A with the guided channel 12H, and inserting the tine 12A via arrow "F" into the channel member 14. The tine 12H is close to the bottom wall 14H" proximate the rear side 14B of the channel member 14. The guided channel 14H is further shaped in a tapered manner so as to accommodate most common types of tines 12A of forklifts 12, as the most common tines 12A of forklifts 12 are tapered in a similar manner thin at one end while being thick at the end proximate the forklift 12.

Figure 8B:
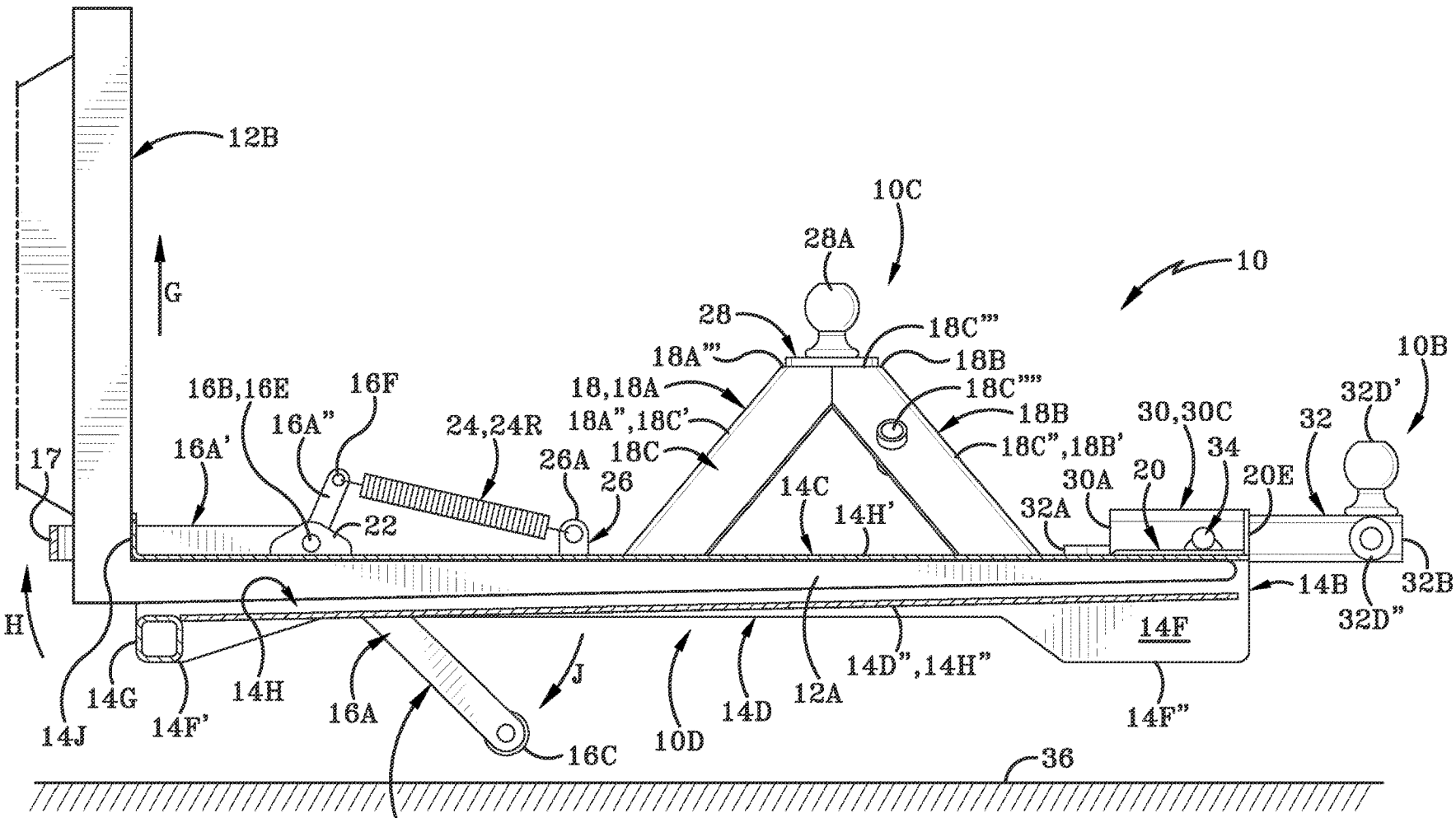
FIG. 8B is a cross-sectional view of the moving apparatus similar to FIG. 7 showing the tine of the forklift fully engaged in the channel member of the moving apparatus, and showing the forklift lifting the moving apparatus off of the support surface or the ground, and further showing the retaining assembly moved to a closed position.

Referring now to FIG. 8B a side cross section operational view of the exemplary trailer mover apparatus 10 engaging a forklift tine 12 into the trailer mover apparatus 10 is shown. Similar to FIG. 7 and FIG. 8A, this view is along the same line 7-7 for the apparatus 10, but the forklift tine 12A has been inserted into the apparatus 10. The exemplary trailer mover apparatus 10 in this figure is shown no longer in contact with a surface 36 as demonstrated by arrow "G" raising the apparatus 10 via the forklift 12.

Lifting the apparatus 10 off the surface 36, the tine 12A remains engaged in the guided channel 14H at its top wall 14H' of the channel member 14. By the movement "G" the retaining assembly 16 is operative to rotate causing the arms 16A to rotate. Specifically, the spring begins to retract to a retracted positon 24R which decreases the stretched distance which in turn allows the retaining assembly 16 to rotate about the retaining pins 16E. The retaining pin 16E allows the arms 16A to rotate about the stationary bases 22. The base 17 of the U-shaped portion 16A' of the arms 16A are operative to rotate via arrow "H" to make contact with the tine 12A while the crossbar 14C rotates via arrow "J". As a result of this rotation via arrow "G", the U-shaped portion 16A' of the arm 16 is in physical contact with the tine 12A of the forklift 12 or is operative to be place behind the tine 12A. This contact of the retaining assembly 16 further secures the forks 12 to the apparatus 10. The rotation "G" is stopped by the retaining ledge 14J so as to not go past being parallel with the channel member 14 to secure the tine 12A of the forklift 12.

Further assisting in allowing the tine 12A of the forklift to be within the channel member 14 is the sloped bottom wall 14H" of the channel member 14. As a result of the guided channel 14H being a tapered channel, the tine 12A has reduced play in a vertical direction. As such, if the forklift 12 were to hit a bump or other imperfection or hazard on the ground, the resulting shock would cause minimal movement of the tine 12A thereby acting as a damping mechanism to such vertical movement.

Figure 9A:
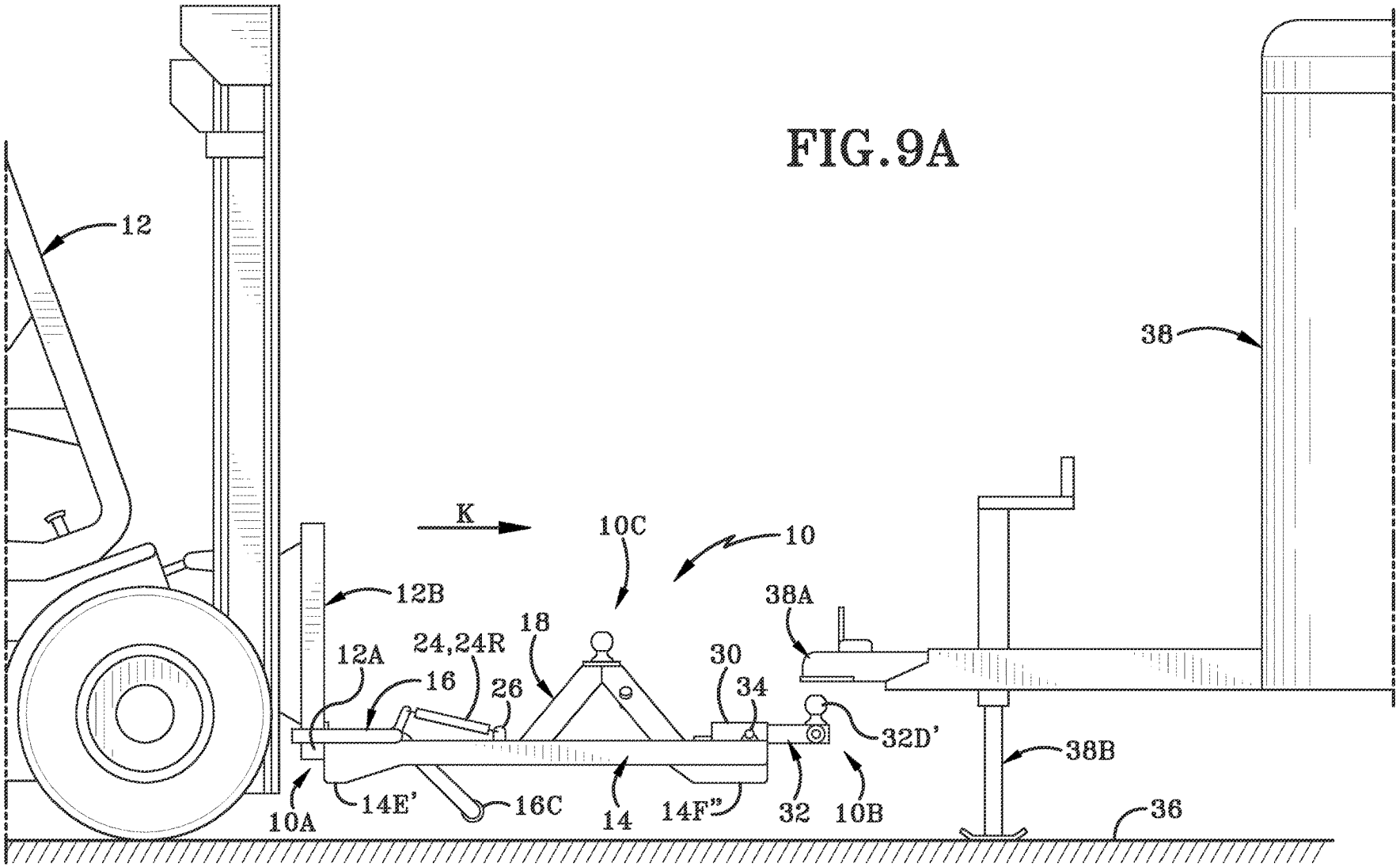
FIG. 9A is a right side elevation view of the moving apparatus engaged with the forklift and being moved towards a trailer having a ball hitch coupler.

Referring specifically to FIG. 9A a side operational view of the exemplary trailer moving apparatus 10 engaged with the forklift 12 approaching a traditional trailer 38 with a coupler 38A is shown. The forklift 12 moving in a direction "K" towards the coupler 38A on the trailer 38. The ball mount 32 along with the hitch 32D' is at a height less than that of the coupler 38A. An operator (not shown) may align the hitch 32D' on the ball mount 32 with the coupler 38A without the need to leave the forklift 12 or disengage any mechanism securing the trailer 38 to the ground such as a trailer jack 38B or other such ground retaining member.

The hitch diameter can be changed prior to approaching the trailer 38 an operator may need to change the hitch diameter depending on the type of trailer coupler 38A. In order to do this, the operator may disengage the pin 34 by grasping the pin 34 and pulling the pin 34 through the aperture 30G at a second side 30F (or a first side 30E) by causing the bearing 34F to depress and continuing to pull and disengaging a through hole 32E' or 32E" before continuing to remove the pin through the first side 30E (or a second side 30F) of the hitch receiver 30 about arrow "A" in FIG. 2A. As a result, the ball mount 32 is no longer engaged with the hitch receiver 30 and is removed via arrow "B" and freely rotated along arrow "C" about the front and back to expose a different hitch such as 32D', 32D" or 32D'". Alternatively, the ball mount 32 is rotated along arrow "D" about the sides to expose the aperture 32C and may install a new hitch, not shown.

The pin 34 placed back into the hitch receiver depending on the desired exposed hitch 32D', 32D" or 32D'" or new hitch installed within the aperture 32C, is placed back into the hitch receiver. In order to do this, the operator will place the second end 34B through the aperture 30G of the hitch receiver 30 at the first side 30E (or the second side 30F). The pin 34 will then pass through either one of the first through hole 34E', or the second through hole 34E", before emerging on the second side 30F (or the first side 30E). The bearing 34F passing through the aperture 30G and is operative to hold the hitch receiver 30 in operative engagement with the ball mount 32.

The choice of hitch to use is up to the operator and the types of trailers to be moved. Similarly, the support frame 20E that is operative to support the entirety of the hitch frame including the hitch receiver 30 and the ball mount 32, particularly trailer 38 is engaging with the ball mount 32. Depending on the weight of the trailer, the frame may be further reinforced or otherwise strengthened to promote structural integrity of the apparatus 10.

Figure 9B:
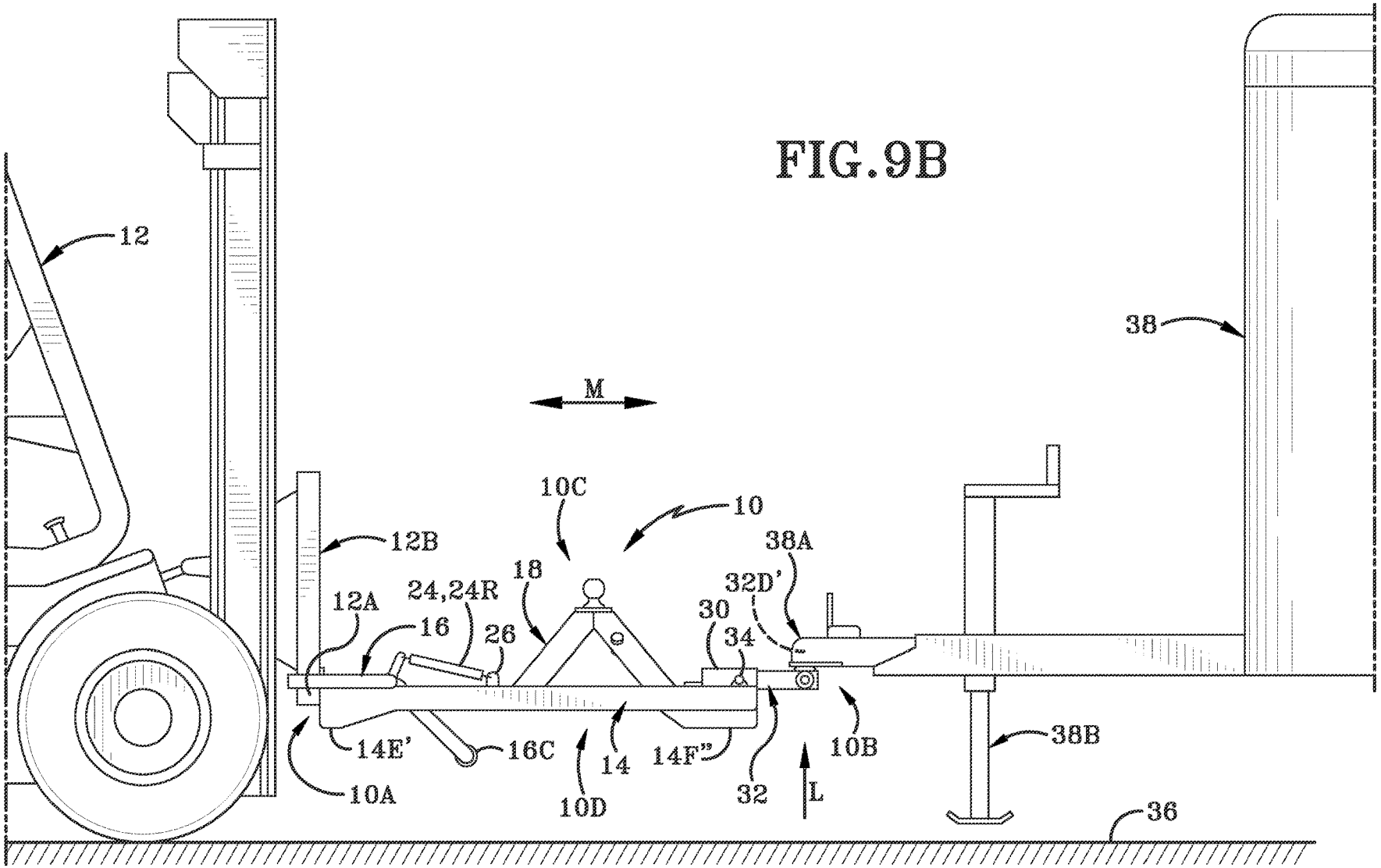
FIG. 9B is a right side elevation view of the moving apparatus being lifted by the forklift and being engaged with the trailer via the ball hitch coupler.

Referring specifically to FIG. 9B, a side operational view of the exemplary trailer moving apparatus 10 engaged with the forklift 12 and engaged with the trailer coupler 38A is shown. The apparatus 10 while coupled to the forklift 12 via the tine 12A in the guided channel 14G of the channel member 14 and held in place via the retaining assembly 16 has been moved in a vertical direction via arrow "L" in order to contact the coupler 38A of the trailer 38. This contact engages the hitch 32D' of the ball mount 32 with the coupler 38A. The movement can then continue moving further vertical about arrow "L" to disengage the jack 38B.

As a result of this vertical movement "L", of the apparatus 10 and now the trailer 38 is able to be freely physically manipulated and moved via arrow "M". This movement may be in a transverse, vertical, or horizontal movement by manipulating the forklift 12 with its movement of wheels and propulsion or the lift on the forklift 12. As such, coupling the trailer to an agile vehicle such as the forklift 12 is operative to quickly and efficiently move trailers through use of the apparatus 10 rather than using a truck or other such similarly situated vehicle.

Figure 10A:
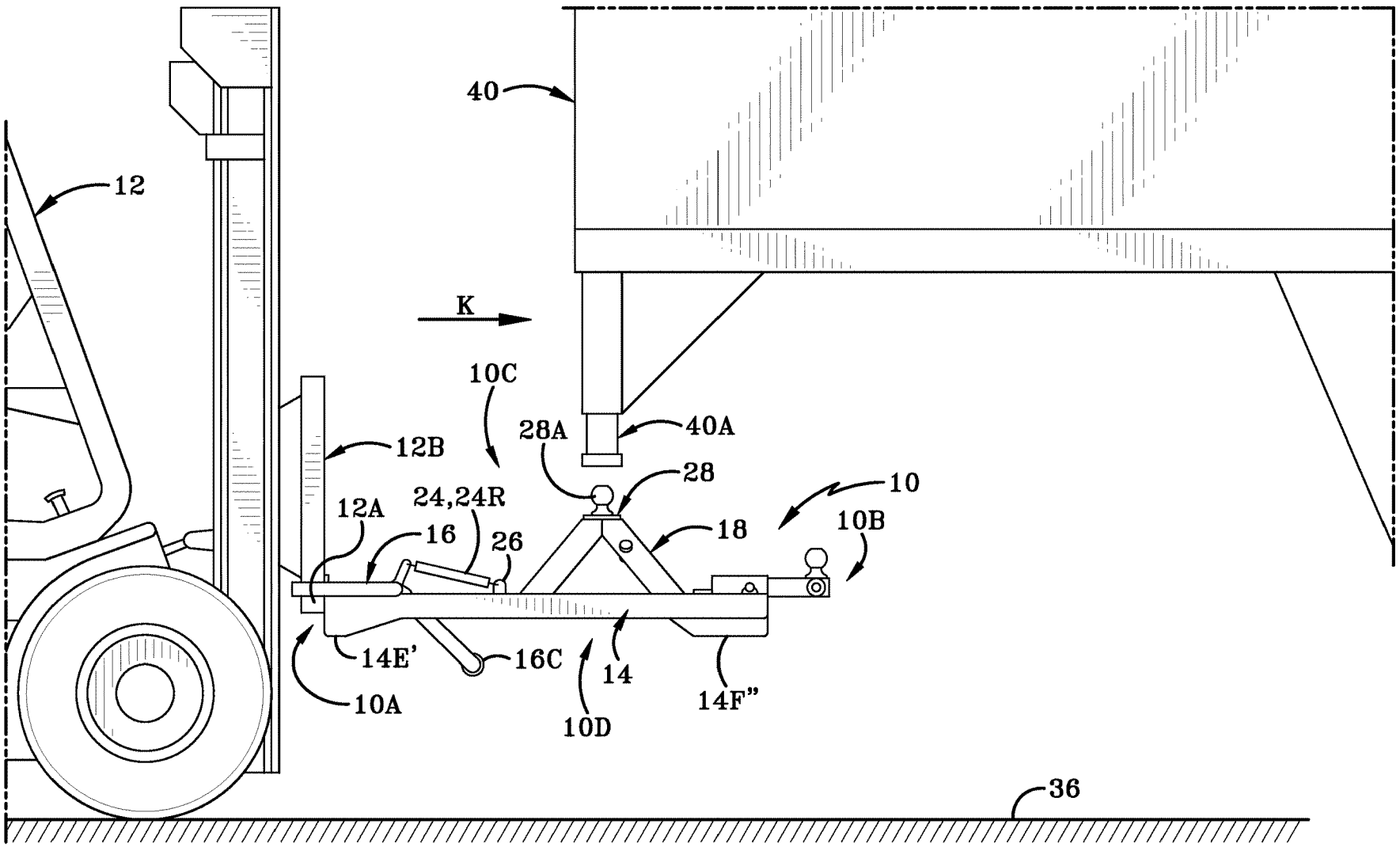
FIG. 10A is a right side elevation view of the moving apparatus engaged with the forklift and approaching a gooseneck style coupler.

Referring specifically to FIG. 10A, a side operational view of the exemplary trailer moving apparatus 10 engaged with the forklift 12 and approaching a gooseneck style trailer hitch 40A on a second trailer 40 is shown. In this figure, the forklift 12 has a vertically higher position of its tines 12A, and thereby the apparatus 10 is at a higher position. Many loads may be too large for the pressure put on the ball mount 32 coupled with the hitch receiver 30 via the pin 34 even with the support frame 20E of the hitch frame 20. As such, the hitch 28A on the engagement platform 28 is attached to the strong pyramidal style frame 18.

Similar to FIG. 9A, in FIG. 10A, the forklift 12 is moved in a direction "K" towards the gooseneck coupler 40A on the trailer 40. The pyramidal frame 18 along with the engagement platform 28 and hitch 28A is at a height less than that of the gooseneck coupler 40A. An operator (not shown) may align the hitch 28A on the engagement platform 28 with the gooseneck coupler 40A without the need to leave the forklift 12 or disengage any mechanism securing the trailer 40 to the ground (not shown).

The choice of hitch to use is up to the operator and the types of loads desired to be moved. Similarly, pyramidal frame 18 that is operative to support the entirety of the engagement platform 28, including the hitch 28A when it is engaged with the trailer 40. Depending on the weight of the trailer 40, the frame 18 may be further reinforced or otherwise strengthened to promote structural integrity of the apparatus 10.

Figure 10B:
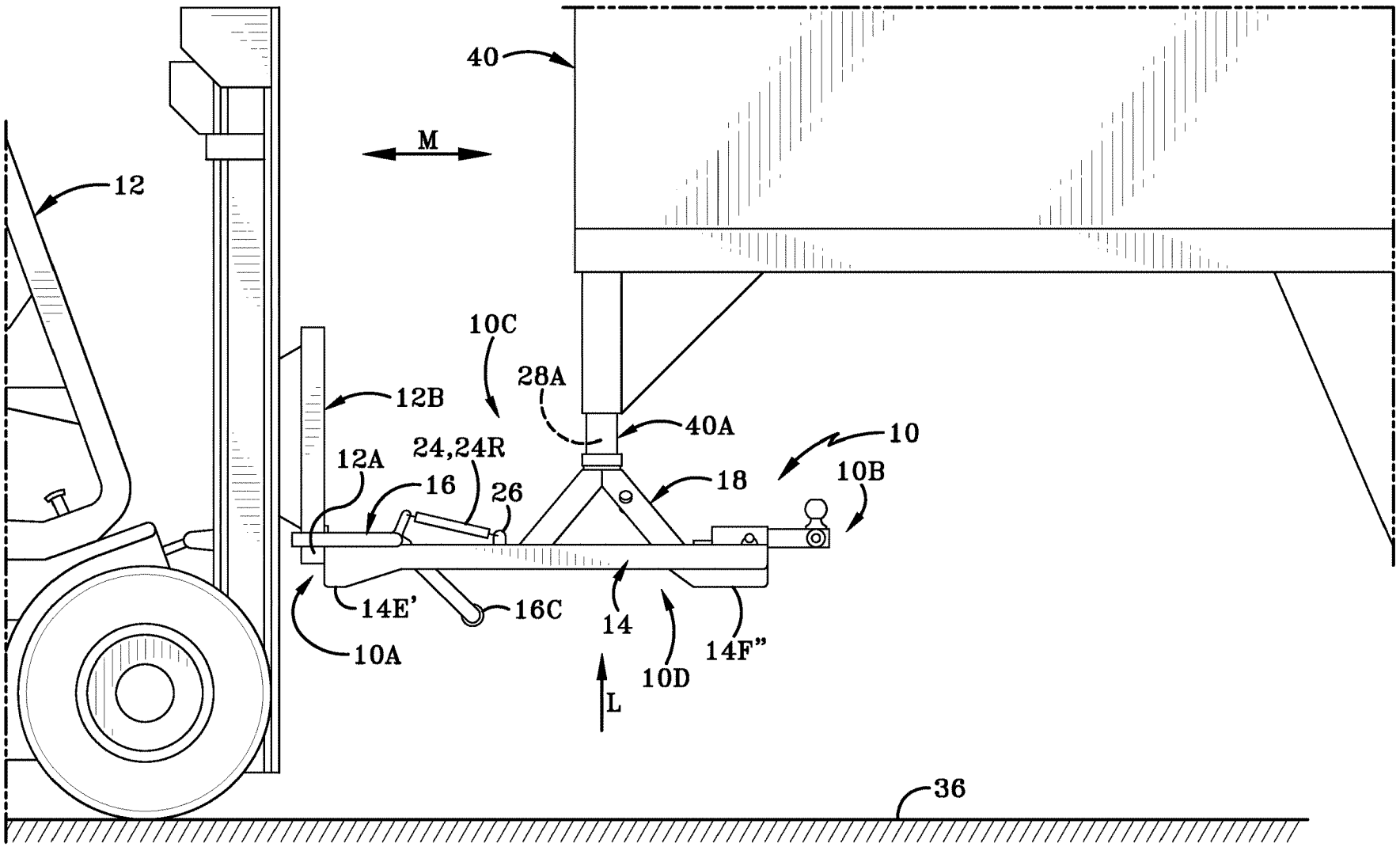
FIG. 10B is a right side elevation view of the moving apparatus being lifted by the forklift and being engaged with the gooseneck style coupler.

Referring now to FIG. 10B, a side operational view of the exemplary trailer moving apparatus 10 engaged with the forklift 12 and engaged with the gooseneck style trailer coupler 40A is shown. Similar to FIG. 9B, the apparatus 10 while coupled to the forklift 12 via the tine 12A in the guided channel 14G of the channel member 14 and held in place via the retaining assembly 16 has been moved in a vertical direction via arrow "L" in order to contact the coupler 40A of the trailer 40. This contact engages the hitch 28A of the engagement platform 28 with the coupler 40A. The vertical movement could continue moving further vertical about arrow "L" if a ground contacting member were present.

As a result of this vertical movement "L", of the apparatus 10 and now the trailer 40 is able to be physically manipulated and moved via arrow "M". This movement may be in a transverse, vertical, or horizontal movement by manipulating the forklift 12 with its movement of wheels and propulsion or the lift on the forklift 12. As such, an agile vehicle such as the forklift 12 is operative to quickly and efficiently move trailers through use of the apparatus 10 rather than using a truck or other such device the trailer would normally be coupled.

While shown for the sake of clarity and ease of understanding, a forklift 12 is shown in the exemplary embodiment. Alternative vehicles such as a pallet stackers or a pallet jack for light trailers or frames of trailers that would need to be moved.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "element A and/or element B", when used in conjunction with open-ended language such as "comprising" can refer, in one embodiment, to element A only (optionally including elements other than element B); in another embodiment, to element B only (optionally including elements other than element A); in yet another embodiment, to both element A and element B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including", "carrying," "having", "containing," "involving," "holding", "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. In combination:

a frame assembly; and a retaining assembly;

wherein the frame assembly includes:

a first channel member extending in a longitudinal direction; and a guided channel formed by the first channel member, said guided channel being adapted to accept a tine of a lifting device therein;

wherein the retaining assembly is operative to retain the tine of the lifting device to the frame assembly, and wherein the retaining assembly comprises:

a first arm of an inverted V-shape having a first end, a second end longitudinally remote from the first end, and an apex located between the first end and the second end;

wherein the apex is adapted to be pivotally engaged with the first channel member via a pivot rod extending from a first side of the first arm;

a first plate extending laterally outwardly from the first side of the first arm proximate the first end thereof; and wherein when the first arm is engaged with the first channel member, the first plate is located a distance outwardly beyond an end of the first channel member which receives the tine of the lifting device therein.

2. The combination of claim 1, wherein the guided channel tapers in height moving longitudinally away from the end of the first cannel member.

3. The combination of claim 1, wherein the frame assembly has an accepting position where the tine of the lifting device is not in physical contact with the first channel member and an engaged position where the tine of the lifting device is in physical contact with the first channel member.

4. The combination of claim 3, wherein the retaining assembly bounds a portion of the tine when in the engaged position.

5. The combination of claim 3, wherein the retaining assembly extends behind the portion of the tine when in the engaged position.

6. The combination of claim 3, further comprising:

a biasing member operative to move the retaining assembly between the accepting position and the engaged position.

7. The combination of claim 6, wherein the biasing member is a spring that extends between the retaining assembly and the frame assembly.

8. The combination of claim 1, wherein the retaining assembly is attached to at least one side of the first channel member.

9. A method for operating a moving apparatus comprising steps of:

providing a frame assembly with a channel member on the moving apparatus, wherein the channel defines a guided channel therein;

providing a retaining assembly on the channel member; wherein the retaining assembly includes an arm of an inverted V-shape having a first end, a second end longitudinally remote from the first end, and an apex located between the first end and the second end;

pivotally engaging the apex of the arm with the channel member via a pivot rod extending from the first side of the arm;

extending a plate laterally outwardly from the first side of the arm proximate a first end thereof;

locating the plate a distance outwardly beyond an end of the channel member;

inserting a tine of a vehicle into the guided channel of the moving apparatus;

lifting the moving apparatus off of a surface;

simultaneously retaining the moving apparatus to the tine of the vehicle with the retaining assembly while lifting the moving apparatus; and moving the moving apparatus with the vehicle while coupled with the tine.

10. The method of claim 9, wherein prior to lifting:

contacting h channel member with the tine.

11. The method of claim 9, wherein retaining comprises:

ensuring that the tine is intermediate the frame and a portion of the retaining assembly.

12. The method of claim 9, wherein simultaneous to lifting:

rotating the retaining assembly relative to the moving apparatus in order to secure the tine of the vehicle to the moving apparatus.

13. The method of claim 12, simultaneous to rotating:

changing a length of a biasing member with respect to the frame assembly.

14. The method of claim 9, wherein prior to engaging the tine:

aligning the tine with the guided channel.

15. The method of claim 9, further comprising:

lowering the moving apparatus; and disengaging the moving apparatus from the tine of the vehicle as a result of contacting the moving apparatus with the surface.

16. The method of claim 15, whereby all steps are done without an operator leaving the vehicle.

17. A retaining assembly for securing a frame assembly to a lifting device, wherein the frame assembly includes a first channel member defining a guided channel into which a tine of the lifting device is received, said retaining assembly comprising:

a first arm of an inverted V-shape having a first end, a second end longitudinally remote from the first end, and an apex located between the first end and the second end;

wherein the apex is adapted to be pivotally engaged with the first channel member via a pivot rod extending from a first side of the first arm;

a first plate extending laterally outwardly from the first side of the first arm proximate the first end thereof; and wherein when the first arm is engaged with the first channel member, the first plate is located a distance outwardly beyond an end of the first channel member which receives the tine of the lifting device.

18. The retaining assembly according to claim 17, further comprising a first support extending from the first plate, wherein the first support is oriented generally parallel to the first arm, and wherein the first support is adapted to be pivotally engaged with the first channel member in a location opposite to where the first arm is pivotally engaged therewith.

19. The retaining assembly according to claim 17, further comprising:

a biasing member engaged with the first arm and being adapted to be operatively engaged with the first channel member.

20. The retaining assembly according to claim 19, further comprising a stanchion extending outwardly from the apex of the first arm, wherein the biasing member is engaged with the stanchion and is adapted to be operatively engaged with the first channel member a distance away from the stanchion.

21. The retaining assembly according to claim 17, further comprising:

a second arm of an inverted V-shape and having a first end, a second end longitudinally remote from the first end, and an apex located between the first end and the second end;

wherein the apex of the second arm is adapted to be pivotally engaged with a second channel member of the frame assembly via a second pivot rod extending from a first side of the second arm;

a second plate extending laterally outwardly from the first side of the second arm and proximate the first end of the second arm; and wherein when the second arm is engaged with the second channel member, the second plate is located a distance outwardly beyond an end of the second channel member which receives another tine of the lifting device therein.

22. The retaining assembly according to claim 21, wherein the first plate and the second plate extend outwardly away from one another in opposite directions.

23. The retaining assembly according to claim 21, further comprising a second support extending from the second plate, wherein the second support is oriented generally parallel to the second arm, and wherein the second support is adapted to be pivotally engaged with the second channel member in a location opposite to where the second arm is pivotally engaged therewith.

24. The retaining assembly according to claim 21, further comprising:

a cross bar extending between the second end of the first arm and the second end of the second arm.

* * * * *